US007300146B2

(12) United States Patent
Roberts

(10) Patent No.: US 7,300,146 B2
(45) **Date of Patent: *Nov. 27, 2007**

(54) EMBOSSING USING CLEAR INK

(75) Inventor: Carrie Roberts, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 612 days.

This patent is subject to a terminal disclaimer.

(21) Appl. No.: 10/394,117

(22) Filed: Mar. 21, 2003

(65) Prior Publication Data

US 2004/0183878 A1 Sep. 23, 2004

(51) Int. Cl.
*B41J 2/01* (2006.01)
*B41J 2/17* (2006.01)

(52) U.S. Cl. ..... 347/101; 347/98

(58) Field of Classification Search ..... 347/98, 347/100, 101, 102, 104; 400/109.1; 703/6; 700/118, 207; 345/581; 355/282, 285, 290
See application file for complete search history.

(56) References Cited

U.S. PATENT DOCUMENTS 3,440,076 A 4/1969 Vaurio
4,095,233 A 6/1978 Goffe
4,101,688 A 7/1978 Kurtzman
4,227,200 A 10/1980 Mansukhani
4,599,627 A 7/1986 Vollert
4,756,758 A 7/1988 Lent et al.
4,792,860 A 12/1988 Kuehrle
4,793,280 A * 12/1988 Menard et al. ..... 118/44
4,805,531 A 2/1989 Sarda
4,849,883 A 7/1989 Mitchell et al.
4,991,539 A 2/1991 Sarda
5,145,519 A 9/1992 Kappele
5,157,761 A 10/1992 Hawkes
5,164,232 A 11/1992 Henseleit et al.
5,207,825 A 5/1993 Schwarz, Jr.
5,286,286 A 2/1994 Winnik et al.
5,328,504 A 7/1994 Ohnishi
5,345,254 A 9/1994 Wong et al.
5,397,673 A 3/1995 Watson et al.
5,563,694 A * 10/1996 Katayama ..... 399/2
5,618,338 A * 4/1997 Kurabayashi et al. .... 106/31.37
5,627,578 A 5/1997 Weintraub
5,699,743 A 12/1997 Ganz et al.
6,106,110 A * 8/2000 Gundjian et al. ..... 347/86
6,123,411 A * 9/2000 Inui et al. ..... 347/43
6,193,361 B1 * 2/2001 Wen ..... 347/84
6,328,408 B1 * 12/2001 Gelbart ..... 347/20
6,350,022 B1 * 2/2002 Takemura et al. ..... 347/85
6,428,148 B1 8/2002 Gore
6,428,155 B1 8/2002 Silverbrook et al.
6,471,426 B1 10/2002 Shepherd et al.

(Continued)

OTHER PUBLICATIONS

Clear Inc., Invisible Imaging"say more—see nothing".

(Continued)

*Primary Examiner*—An H. Do

(57) ABSTRACT

A printing device including a plurality of cartridges, at least one cartridge including a visible ink and at least one cartridge including a clear ink; a print portion; and an accessory module in connection with the print portion; wherein the clear ink of at least one cartridge has a longer drying time than the visible ink of at least one cartridge.

39 Claims, 6 Drawing Sheets

U.S. PATENT DOCUMENTS

| | | | | |
|---|---|---|---|---|
| 6,480,217 | B1 * | 11/2002 | Inoue et al. | 347/212 |
| 6,863,392 | B2 * | 3/2005 | Shimomura et al. | 347/100 |
| 2001/0020964 | A1 * | 9/2001 | Irihara et al. | 347/43 |
| 2004/0153204 | A1 * | 8/2004 | Blanco | 700/207 |
| 2004/0196348 | A1 | 10/2004 | Roberts | |

OTHER PUBLICATIONS

Clear, Inc. "Clear Is Cool!".
USPTO Office Action in re: U.S. Appl. No. 10/407,631, filed Apr. 1, 2003.

* cited by examiner

EMBOSSING USING CLEAR INK

BACKGROUND

Embossing is a technique that produces raised or depressed portions on a surface in accordance with the shape and contours of a desired pattern or design. With some prior embossing techniques, images or text are printed in ink on a print media, such as paper. The print media is ejected from the printing device and an embossing powder is applied and adheres to portions of the media where the ink remains wet. Thereafter, the media is heated to melt the powder and produce raised or "embossed" portions.

With some inkjet printers, it is often difficult to create a document where the ink remains wet long enough to proceed with embossing. It is also difficult to get consistent embossing results through a full range of color prints because the primary colored inks often dry at different rates, causing the powder to stick inconsistently.

Varieties of colored embossing powders are available to provide a desired color affect to a document being embossed. However, relying upon multi-colored powders to achieve desired color affects may be limiting in a number of circumstances. Among other things, the ability to achieve a desired affect could be substantially restricted by the unavailability of one or more colored powders. Further, such powders may have to be embossed separately to avoid undesirable mixing or blending of different colored powders.

Another disadvantage of some prior embossing techniques is their inability to emboss areas of a media where no visible ink has been applied.

For these and other reasons, there is a need for the present invention.

SUMMARY OF THE INVENTION

An embodiment of the invention is directed to a printing device with at least one cartridge that uses a clear liquid or ink for embossing.

Other aspects of the invention will be apparent to those skilled in the art after reviewing the drawings and the detailed description below.

BRIEF DESCRIPTION OF THE DRAWINGS

Embodiments of the present invention will now be described, by way of example, with reference to the accompanying drawings, in which.

NOTE: The figures are each individually described in the detailed description, so the descriptions here were kept minimal with the thought being that anything said here would probably do nothing but potentially serve to limit associated constructions.

DETAILED DESCRIPTION OF EMBODIMENTS

It is to be understood that the present invention may be embodied in other specific forms without departing from its essential characteristics. The illustrated and described embodiments are to be considered in all respects only as illustrative and not restrictive. The scope of the invention is, therefore, indicated by the appended claims rather than by the foregoing description. All changes that come within the meaning and range of equivalency of the claims and included elements are to be embraced within their scope.

Figure 1A:
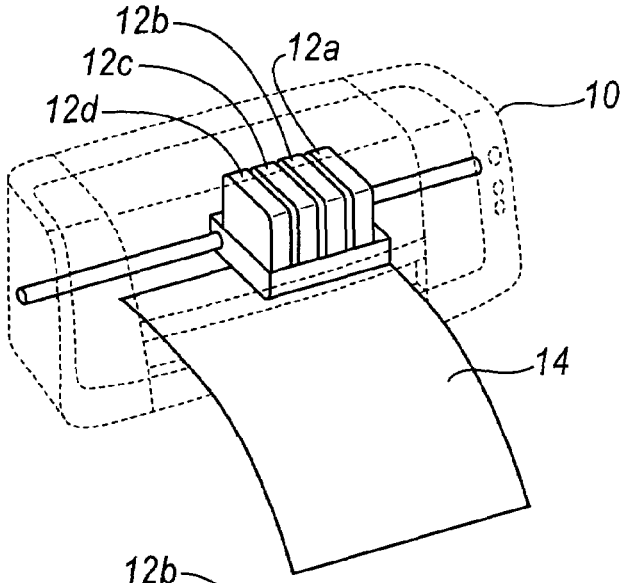
FIGS. 1A through 1C are perspective schematic views of a printing device for embossing according to several embodiments of the present invention.
Figure 1B:
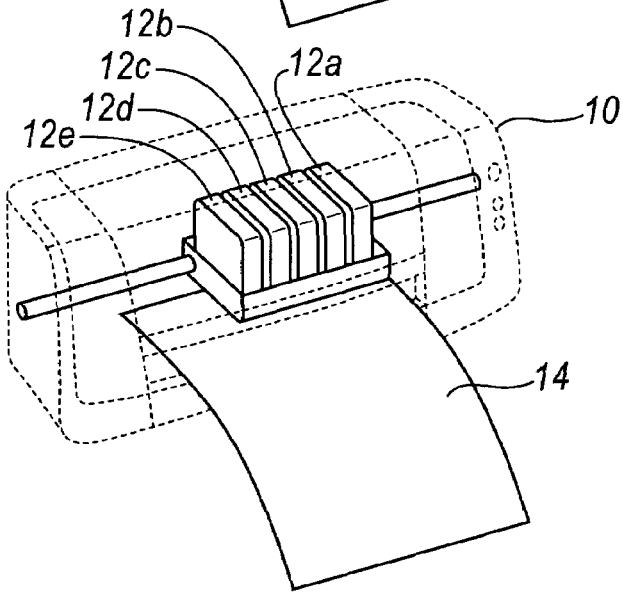
Figure 1C:
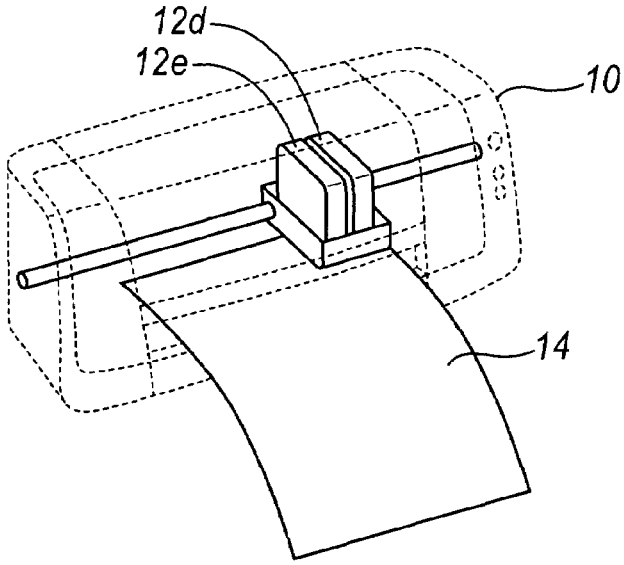

Referring now to FIGS. 1A-1C, embodiments of the present invention are shown and described. In FIG. 1A, a printer 10 is shown including ink cartridges, which are generally identified as element 12. The term "cartridges" is used herein in a broad sense and may include, without limitation, a wide variety of liquid and ink delivery devices associated with printing mechanisms. In the illustrated embodiment, printer 10 uses ink cartridges 12*a*, 12*b*, 12*c* and 12*d* to apply ink and other substances to print media 14. Print media 14 is run through or otherwise disposed within printer 10 and is comprised of paper or other known printable material. Non-limiting examples of the interaction of print cartridges 12 with printer 10 for disposing ink or other liquid on print media 14 is generally disclosed in U.S. Pat. No. 6,471,426, which is incorporated herein by reference.

Referring again to the embodiment of FIG. 1A, four ink cartridges, 12*a* through 12*d* are depicted. Ink cartridges 12*a*, 12*b*, and 12*c* may include primary colors, such as magenta, yellow, and cyan. As will be readily understood to one skilled in the art, these or other primary colors can typically be combined to print virtually any color in a visible spectrum. Additionally, in accordance with an embodiment of the invention, ink cartridge 12*d* is also provided.

Ink cartridge 12*d* includes a clear, substantially clear ink, or invisible ink or other liquid (i.e., "clear ink" or "clear liquid"). The clear ink or liquid has a longer drying time than that of the ink in ink cartridges, i.e., in the illustrated case, cartridges 12*a*-12*c*. The term "drying time" refers to the time that it takes an ink or liquid to transform from a wet applied state on a media to a state where it is not wet or is dry. Generally, the clear ink can be comprised of any desirable clear or substantially clear liquid that does not destroy the print media 14 and allows colors on the print media 14 to show through and provides a sufficiently long drying time to allow the embossing steps after the print media 14 has been printed. An example of a clear ink that may be used in an ink cartridge, such as illustrated ink cartridge 12*d*, is one commercially marketed by Inc.jet Inc. of Norwich, Conn. under the trade designations "inc.jet" and "clear.inc".

The use of a comparatively "slower" drying clear ink can be particularly desirable for inkjet embossing techniques where, if all ink cartridges contain slow drying ink, everything printed on the media could remain wet at the same time. The selection and use of such a comparatively slower drying clear ink better assures that only the desired embossing regions of the media remain wet. Further, the clear ink is one that does not undesirably degrade or distort the printed image below it. Further, because it is substantially clear or transparent, the clear ink can be used to print on top or over virtually any color design that has been previously printed on the media. In an embodiment, clear embossing powder can then be used to provide a raised or embossed affect while showing the printed colors beneath. With such embodiments, essentially any color of embossing can be achieved using a single embossing powder, such as a clear embossing powder.

Further, portions of the media can be embossed regardless of whether visible ink has been applied. In such embodiments, there may be some portions of the media to be embossed where only clear ink is applied and is later covered by embossing powder. This technique can be useful, for example, when embossing transparent Braille text on a sheet or over the top of a blank sheet or one with visibly printed text.

Referring now to FIG. 1B, another embodiment of the invention is shown and described. In FIG. 1B, an additional ink cartridge 12*e* is shown. Ink cartridge 12*e* contains a single, dark color of ink (e.g., black) for printing text without combining inks from several cartridges. The use of the cartridge 12*e* may be of particular use in instances when black text may be all that is required by the user or printer. For some applications, particularly where the number of cartridges is limited, the additional cartridge 12*e* may instead be swapped in or out with one of the other cartridges. However, depending upon the circumstances, including those that would place an undesirable burden on the user, the cartridge 12*e* may be maintained in the printer 10.

In FIG. 1C, another embodiment of the invention is shown and described. Here, only ink cartridges 12*d* and 12*e* are shown. Thus, the printer 10 for the embodiment depicted in FIG. 1*c* prints only black ink or clear ink on the print media 14. One skilled in the art will readily recognize that numerous combinations of ink cartridges may be used, and that the invention is not intended to be limited to only the embodiments that are shown and described herein.

Referring now to FIGS. 2A through 2F, the operation of an embodiment of the invention is shown and described in further detail. However, it is understood that the illustrated embodiment is not restrictive and any of the ink cartridge configurations shown in FIGS. 1A, 1B, or 1C, as well as any additional ink cartridge configurations understood by one skilled in the art can instead be employed.

Figure 2A:
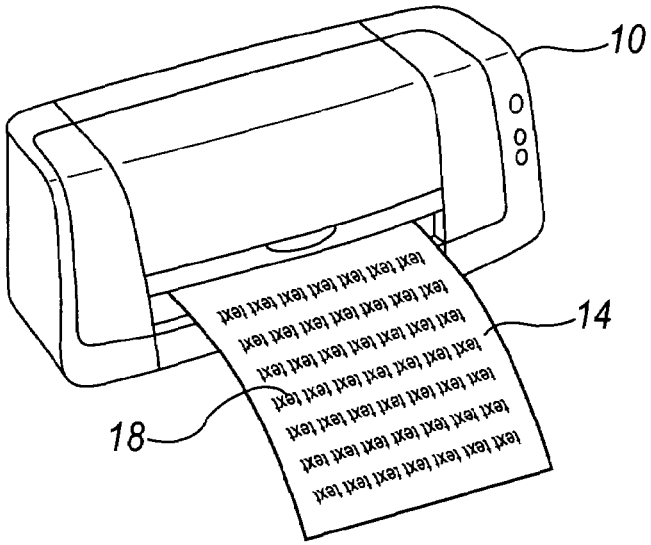
FIGS. 2A through 2G are perspective schematic views of a printing device for embossing according to another embodiment of the present invention.
Figure 2B:
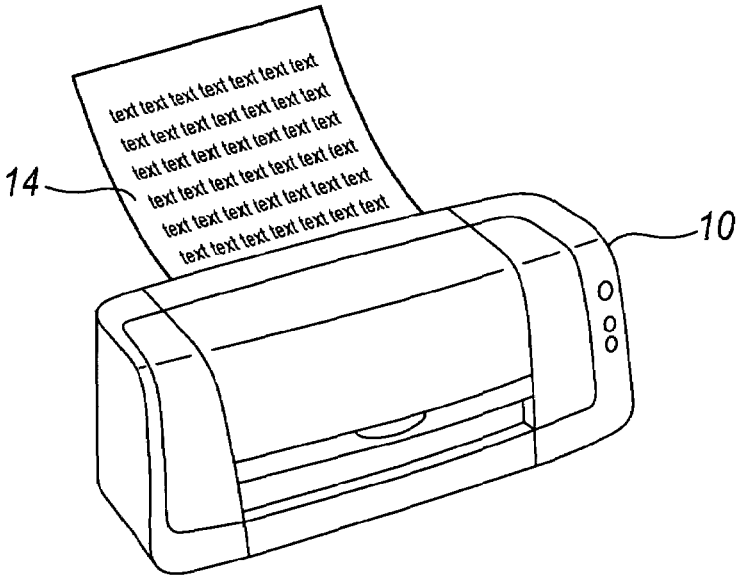
Figure 2C:
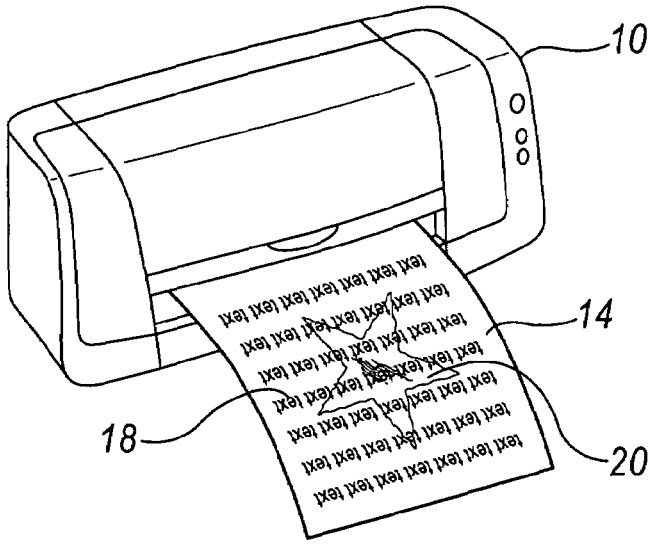

In FIG. 2A, print media 14 is fed through printer 10 to allow ink cartridges, such as ink cartridges 12*a*, 12*b*, 12*c* or 12*e*, to apply visible ink 18 to the media 14. The applied visible ink 18 may be in the form of text or other desired printed images. Next, print media 14 is "backed out" or otherwise transferred or conveyed through printer 10, for example, to approximately its initial print position, such as shown in FIG. 2B. That is, the printer 10 may advance the media 14 back through the printer 10 in a direction opposite the direction of movement during printing the visible ink 18. Then, for instance as shown in FIG. 2C, print media 14 is again fed or otherwise transported through printer 10 to allow an ink cartridge (e.g., 12*d*) to print clear ink 20 on the print media 14. Cartridge 12*d* applies the clear ink 20 in the shape of a desired image or regions to be embossed. The example depicted in FIG. 2 illustrates a star-shaped image that is formed with clear ink 20. The clear ink 20 has a drying time that allows it to remain wet after it is completely applied to print media 14. Further, as the clear ink 20 is clear or substantially clear, it allows the colors of ink 18 to appear or show through the clear ink without unsatisfactory visual obstruction.

Figure 2D:
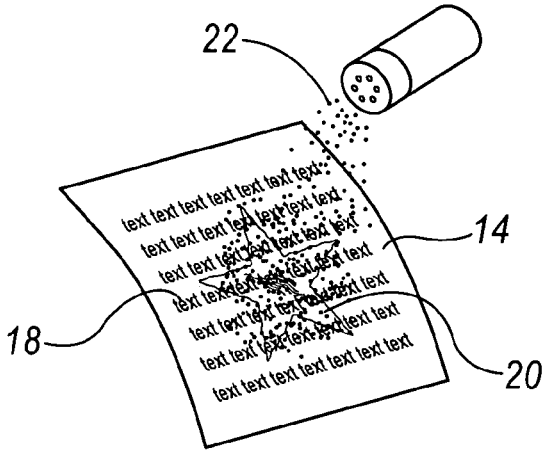

Next, as generally represented in FIG. 2D, an embossing powder 22 is applied to the print media 14 so that the powder substantially covers the portions that include clear ink 20. The embossing powder 22, sticks or generally adheres to the still wet (i.e., non-dry) portions of clear ink 20, but does not substantially stick or remain attached to the portions of visible ink 18 that have already dried.

Figure 2E:
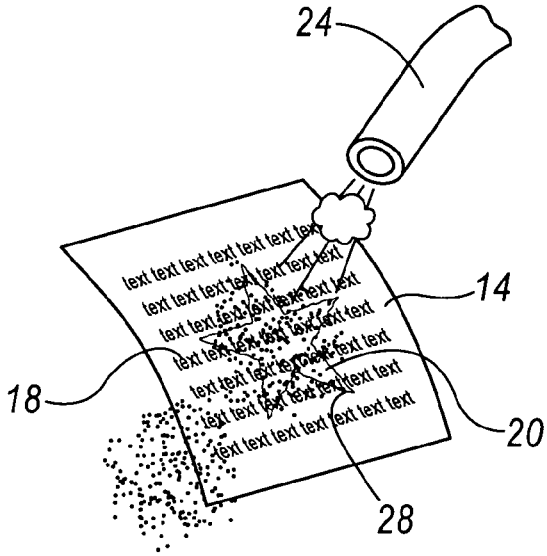

As generally illustrated in FIG. 2E, the excess powder, i.e. that which did not adhere to the wet portions of the media, is substantially removed—typically by blowing it (as shown) or by vacuuming it away from the media or by shaking the media. In the illustrated embodiment an air gun 24 is depicted blowing the excess embossing powder 22 away from the media. However, other methods for removing excess powder as known to those in the art may also be utilized. Such alternative methods, which may or may not be non-contact, include those that employ a blowing device and/or a vacuum, those that reorient the sheet or the device and use gravity to remove the excess powder, or those that use various combinations of the foregoing.

Figure 2F:
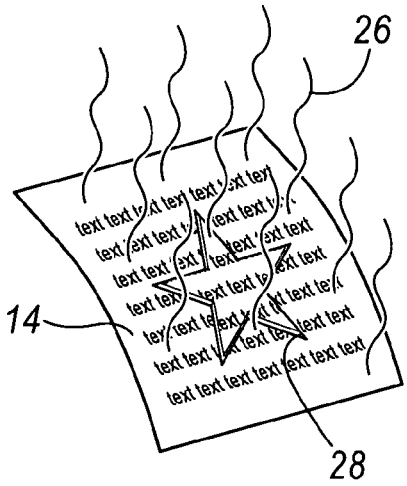
Figure 2G:
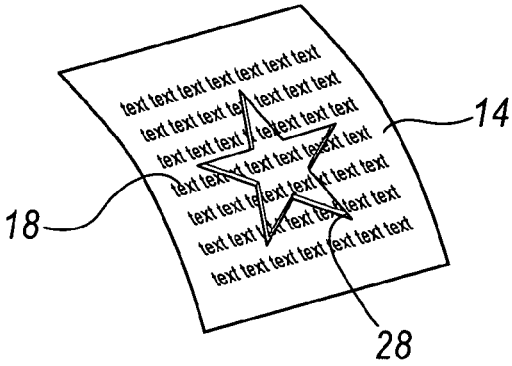

As generally represented in FIG. 2F, energy or heat 26 may then be applied to the print media 14 to activate or melt the granulites of embossing powder 22 to form an embossed portion, such as the one shown in FIG. 2G. In one embodiment, the heat 26 may be applied by an embossing gun (not shown). Further, the heat 26 may be applied to either surface of the print media 14.

Figure 3A:
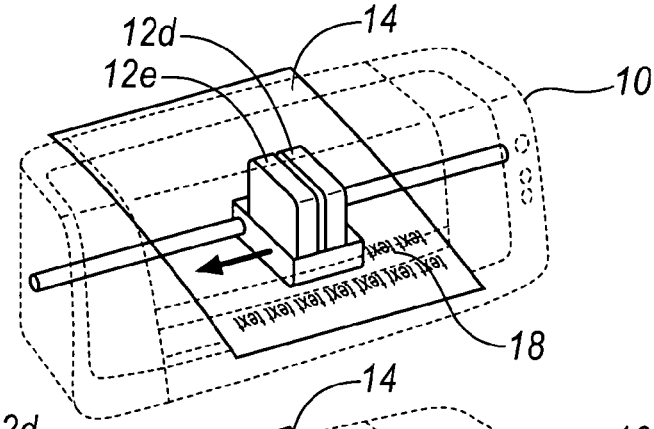
FIG. 3A through 3H are perspective schematic views of a printing device for embossing according to another embodiment of the present invention.

Referring next to FIGS. 3A-3H, another embodiment of the invention is shown and described. The embodiment of FIGS. 3A-3H applies both ink 18 and clear ink 20 in a substantially line-by-line manner or row-by-row manner such that the print media 14 is not required to be advanced through the printer 10 more than once. In FIG. 3A, an ink cartridge configuration similar to FIG. 1C is shown as an example. However, it is noted that any of the ink cartridge configurations previously shown or described, as well as any other configurations understood by one skilled in the art may be employed.

As generally illustrated in FIG. 3A, an ink cartridge (such as 12*e*) applies ink 18 to a print media 14. In this particular embodiment, one single line or strip of writing and/or a desired image is applied with ink 18. At some point prior to or promptly following the printing of the line or strip of ink, the printer determines whether or not a portion of the desired embossing is intended to be present on that line or strip and, if so, a cartridge (such as 12*d*) applies clear ink 20 to the appropriate location on the print media 14. It is to be noted that the clear ink can be applied in a number of manners, several of which may optionally be handled by a single device based on programming and/or flexible cartridge configuration.

Figure 3B:
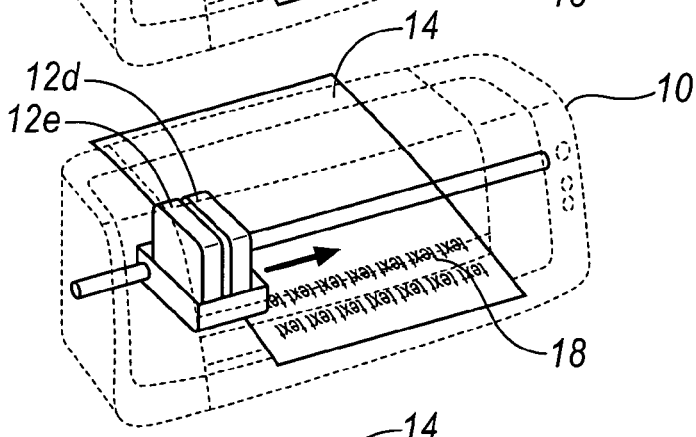

For example, as shown in FIG. 3B, a cartridge having clear ink 20 can "return" (or move in the opposite direction) along the same line or strip that was just printed. However, if desired, and under appropriate ink and drying conditions and interactions, a cartridge having clear ink can follow the cartridge or cartridges applying ink and apply clear ink in a trailing manner in the same direction on the same print row. A configuration of the type shown in the instant embodiment may eliminate the need for the cartridges to return along the same line or strip that has just been printed. In instances in which the cartridges move and follow one another in a generally linear, row-by-row type manner, clear ink cartridges may optionally be included at end positions with respect to the cartridges that apply ink. For example, without limitation, in an embodiment such as illustrated in FIG. 1B, the printer 10 may include at least two clear ink cartridges (e.g., 12*a* and 12*e*) that are separated by one or more visible ink cartridges (e.g., 12*b*, 12*c*, and 12*d*). In this embodiment, irrespective of the direction of travel of the cartridges on a given row, a cartridge containing clear ink will be available to supply clear ink after one or more cartridges provide visible ink to a given position on a row without reversing direction. In addition to potentially storing a larger volume of clear ink for use, such an arrangement can permit the device to print ink and a trailing clear ink (when desired on the subject row or line) on a row-by-row type basis without requiring backtracking or repeating movement of the ink delivery means across a row more than once, which in turn can improve the speed associated with the device.

Figure 3C:
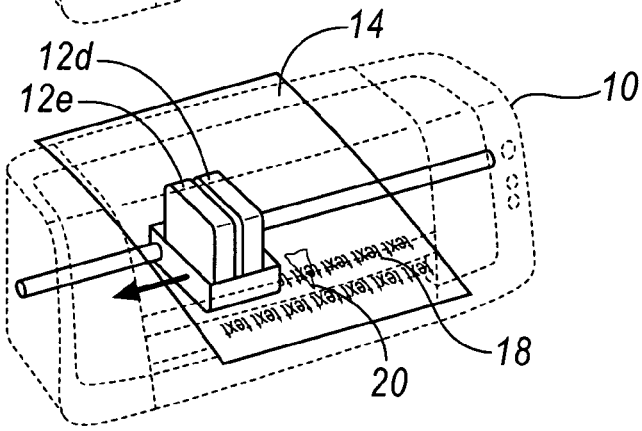
Figure 3D:
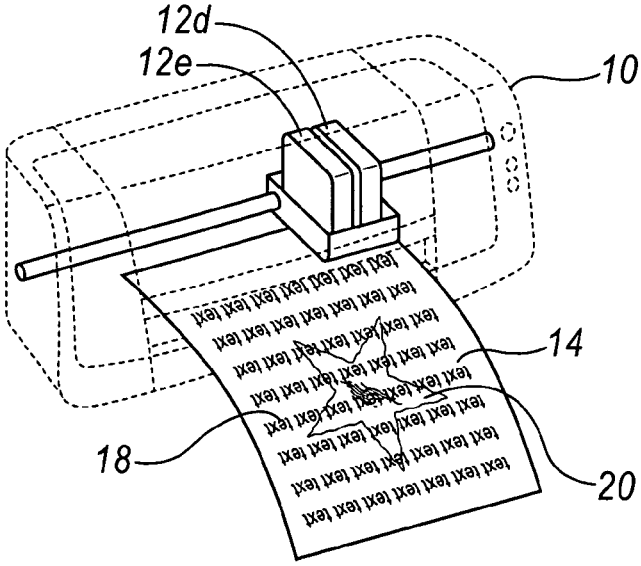

As shown by way of example in FIG. 3C, ink cartridge 12*d* has applied clear ink 20 to the desired area on print media 14 along the same row or line associate with ink 18. As shown in FIG. 3D, the foregoing process may be continued line by line along the length of the page until all desired ink 18 and clear ink 20 is applied to print media 14 to form both the desired inked images and embossing images.

Figure 3E:
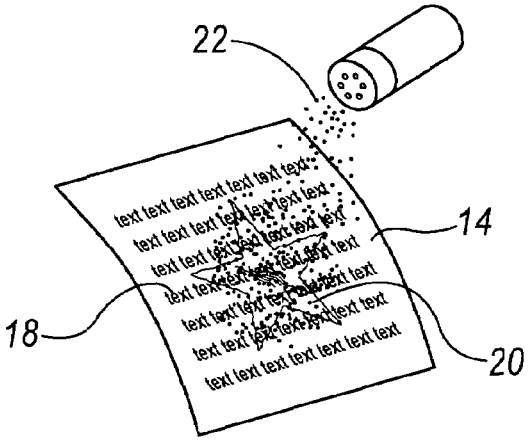

Subsequently, the finished print media 14 is transferred from the printer 10 (or portion of the printer that applies ink) with the image complete thereon. In the present embodiment, clear ink 20 has a slower drying time than ink 18, such that the ejected print media 14 has wet clear ink 20 and dry ink 18 thereon. Next, as generally represented in FIG. 3E, an embossing powder 22, which may be thermally activated, is applied to print media 14 over clear ink 20. The embossing powder 22 then sticks or adheres to the wet portions that include a clear ink 20 and does not substantially stick or adhere to the dry portions.

Figure 3F:
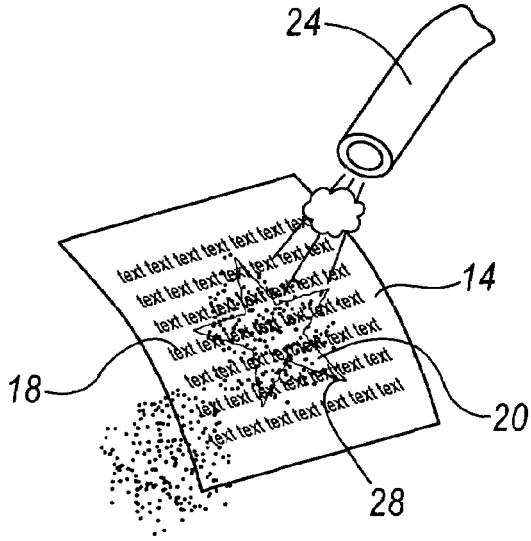
Figure 3G:
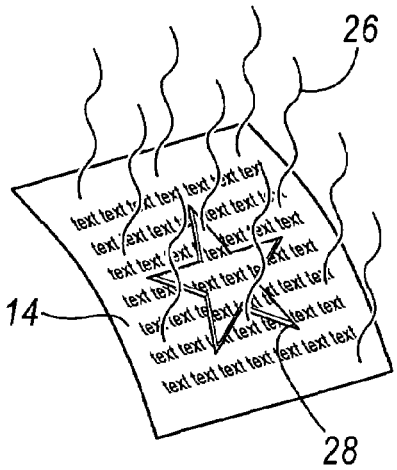
Figure 3H:
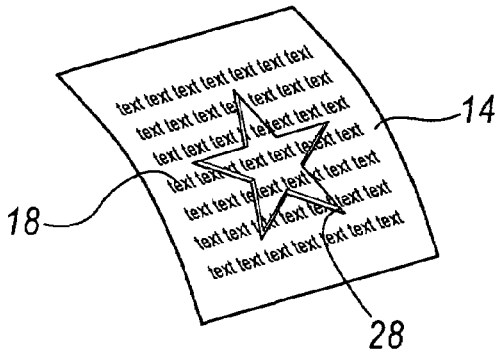

Subsequently, as previously described in connection with prior embodiments, the excess powder 22 is removed from the print media 14. FIG. 3F shows one method for removing the excess powder using an air gun or other blowing means 24 to push extra powder from print media 14, such that substantially only the powder 22 associated with the desired raised powder image 28 remains. As previously noted, a vacuum may also be used either in addition to or in place of the blowing means 24. As generally illustrated in FIG. 3G, energy or heat 26 is applied to the raised powder image 28 to solidify and harden the embossing powder 20 thereon. As a result of the application of energy or heat, the powder 22 is activated and results in an embossed image, such as the example shown in FIG. 3H.

Figure 4:
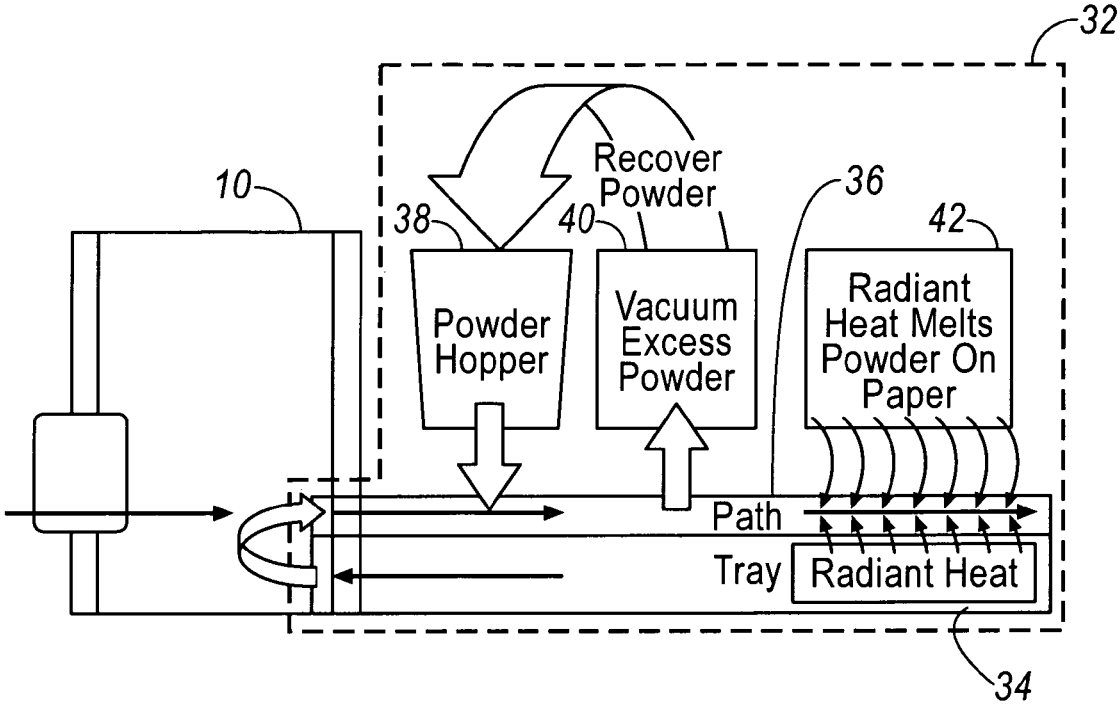
FIG. 4 is a side schematic view of a printing device for embossing according to another embodiment of the present invention.

Referring now to FIG. 4, another embodiment of the present invention is shown and described. In FIG. 4, printing means or printer 10 is shown including an accessory module 32, which may be connected to the printer or included as an integral component thereto.

As shown by way of example in the illustrated embodiment, accessory module 32 includes a print media tray 34 for storing print media, print media path 36, powder hopper 38 for storing embossing powder 22, vacuum 40, and heater 42.

When present, print media tray 34 may store print media. However, it is understood that print media may be stored in other areas and does not have to be stored within the accessory module 32. Print media path 36 provides a path for finished printed print media to travel and also to be processed by accessory module 32 for embossing, as will be described in greater detail. Powder hopper 38 is associated with or attached to print media path 36 to apply embossing powder 22 to the print media being processed. Vacuum 40 acts similar to air gun 24 in that it removes excess embossing powder from the print media. Additionally, vacuum 40 removes the excess embossing powder and places it back within powder hopper 38 for recycle or reuse. Heater 42 applies sufficient energy or heat to the print media to allow activate the powder and perform the embossing function on the print media.

In one operative embodiment, print media is fed from the print media tray 34 into printer 10 for processing according to any of the above embodiments. The processed print media, now including both ink 18 and clear ink 20 is then fed into print media path 36. As the print media is fed along print media path 36, powder hopper 38 disposes embossing powder 22 onto the print media. The print media then continues along print media path 36, positioning it under vacuum 40. Vacuum 40 vacuums excess embossing powder and then feed it back into powder hopper 38. As the print media continues down print media path 36, heater 42 applies sufficient heat to print media to melt and finalize the embossed image.

While the present invention has been particularly shown and described with reference to the foregoing embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A printing device comprising:

a plurality of cartridges, at least one cartridge including a visible ink and at least one cartridge including a clear ink;

a print portion; and an accessory module in connection with the print portion;

wherein the clear ink of at least one cartridge has a longer drying time than the visible ink of at least one cartridge.

2. A printing device according to claim 1, wherein at least one cartridge is removable and interchangeable.

3. A printing device according to claim 1, wherein the clear ink of at least one cartridge has a longer drying time than all of the other visible ink included in the cartridges of the printing device.

4. A printing device according to claim 1, wherein the accessory module further includes:

a print media path adapted to receive print media from the print portion;

a powder hopper engaged with the print media path and adapted to dispense an embossing powder on the print media;

a powder removal mechanism operatively coupled with the print media path and adapted to remove excess powder from the print media; and a heater operatively coupled to the print media path and adapted to supply energy or heat to the embossing powder.

5. A printing device according to claim 4, wherein the powder removal means includes a blower or blowing means, a vacuum or vacuum means, or a combination of one or more of the foregoing.

6. A printing device according to claim 4, further comprising:

a print media tray disposed adjacent to the print media path and configured to receive output from the print portion;

wherein the print portion is adapted to retrieve print media from the print media tray.

7. A printing device comprising:

a plurality of cartridges, at least one cartridge including a visible ink and at least two cartridges including a clear ink;

wherein the clear ink of at least one cartridge has a longer drying time than the visible ink of at least one cartridge and the two cartridges including clear ink are substantially separated by one or more cartridges including visible ink.

8. A printing device comprising:

a plurality of cartridges, at least one cartridge including a visible ink and at least one cartridge including a clear ink, the clear ink of at least one cartridge has a longer drying time than the visible ink of at least one cartridge;

a print portion containing both the at least one cartridge including visible ink and the at least one cartridge including clear ink; and an accessory module in connection with the print portion, the accessory module further including:

a print media path adapted to receive print media from the print portion;

a powder hopper engaged with the print media path and adapted to dispose an embossing powder on the print media a powder removal mechanism operatively coupled with the print media path and adapted to remove excess powder from the print media; and a heater operatively coupled to the print media path and adapted to supply energy or heat to the embossing powder;

wherein: the powder hopper is positioned in an upstream position along the print media path from the powder removal mechanism; and the powder removal mechanism is positioned an upstream position along the print media path from the heater.

9. A printing device for embossing media, comprising:

means for applying visible ink to the media;

means for applying a clear liquid to portions of the media; and means for applying an embossing powder to portions of the media that includes clear liquid after the visible ink has dried and before the clear liquid dries.

10. A device according to claim 9, including a means for activating the embossing powder to form an embossed portion.

11. A method for embossing media comprising:

applying a visible ink to the media;

applying a clear liquid to the media; and applying an embossing powder to the clear liquid after the visible ink has dried and before the clear liquid dries to form an embossed image.

12. A method according to claim 11, wherein the visible ink forms a desired printed image and the clear liquid forms a desired embossed image.

13. A method according to claim 11, wherein the clear liquid has a longer drying time than the visible ink.

14. A method according to claim 11, wherein all of the visible ink is applied to the media before the clear liquid is applied.

15. A method according to claim 11, wherein the visible ink and clear liquid are applied to the printed media one row at a time.

16. A method according to claim 11, further comprising:

removing excess embossing powder from the media after the embossing powder has been applied to the media.

17. A method according to claim 16, wherein the removing of excess embossing powder includes blowing, vacuuming, or a combination blowing and vacuuming.

18. A method according to claim 11, further comprising:

providing energy or heat to the embossing powder on the media to form an embossed image.

19. A method according to claim 11, further comprising:

advancing the media along a print media path after the visible ink and clear liquid have been applied to the print media; and applying the embossing powder to the print media with a powder hopper operatively coupled to the print media path.

20. A method according to claim 11, further comprising:

removing excess embossing powder from the media after portions of powder have adhered to portions of the clear liquid on the media.

21. A method according to claim 20, further comprising capturing and recycling the removed excess embossing powder.

22. The method of claim 11 further comprising:

applying the visible ink and the clear liquid to the media during a first pass across the media in a first direction; and applying the visible ink and the clear liquid to the media during a second pass across the media in a second opposite direction.

23. A method for embossing a media comprising:

providing a printer with one or more cartridges, at least one cartridge including a clear liquid;

applying a clear liquid to the media; and applying an embossing powder to the clear liquid while the liquid is clear and before the clear liquid dries to form an embossed image.

24. A method according to claim 23, wherein a portion of the embossed image includes Braille.

25. A printing device for embossing a media comprising:

a plurality of cartridges, at least one cartridge including a visible ink and at least one cartridge including a clear ink, and an embossing powder dispensing device adapted to dispense an embossing powder on the media, wherein the clear ink of at least one cartridge has a longer drying time than the visible ink.

26. A printing device comprising:

a visible ink delivery device made to deliver visible ink to a print medium; and a clear liquid delivery device configured to deliver clear liquid onto the print medium after the visible ink has been delivered onto the print medium;

a powder depositing device configured to dispose embossing powder onto the print medium, wherein the powder depositing device is configured to deposit embossing powder onto the print medium after the visible ink is dry and while the clear liquid is wet.

27. The device of claim 26, wherein the clear liquid delivery device is configured to deliver clear liquid on top of the visible ink after the visible ink has dried.

28. The device of claim 26, wherein the clear liquid delivery device is configured to deliver the clear liquid to portions of the print medium not containing the visible ink.

29. The device of claim 26, wherein the clear liquid has a longer drying time than visible ink.

30. The device of claim 26 including the device configured to supply energy or heat to the embossing powder deposited upon the print medium.

31. The device of claim 30 including a powder removal device configured to remove embossing powder not adhered to clear liquid on the print medium.

32. The device of claim 26 including:

a powder hopper configured to deposit embossing powder on to the print media;

a heater configured to supply energy or heat to the deposited embossing powder; and a powder removal mechanism positioned upstream from the heater.

33. A method for embossing media, the method comprising:

applying a visible ink to a media;

applying a clear liquid to the media after the visible ink has been applied to the media, wherein the clear liquid is applied to the media after the visible ink has dried; and applying an embossing powder to the clear liquid, wherein the embossing powder is applied after the visible ink has dried and before the clear liquid has dried.

34. The method of claim 33, wherein the clear liquid is applied on to the visible ink after the visible ink has dried.

35. The method of claim 33, wherein the visible ink is applied to a first portion of the print media and the clear liquid is applied to a second distinct portion of the print media.

36. The method of claim 33 including activating the embossing powder after the embossing powder has adhered to the clear liquid on the print media.

37. The method of claim 33 including removing embossing powder not adhered to the clear liquid on the print media.

38. A method comprising:

applying a visible ink to a media to form visible text on the media;

applying a clear liquid to the media in a Braille pattern; and applying an embossing powder to the clear liquid after the visible ink has dried and before the clear liquid dries to emboss the Braille pattern.

39. A printing device comprising:

a plurality of cartridges, at least one cartridge including a visible ink and at least one cartridge including a clear ink;

wherein the clear ink of at least one cartridge has a longer drying time than all of the other visible ink included in the cartridges of the printing device.

* * * * *

UNITED STATES PATENT AND TRADEMARK OFFICE

CERTIFICATE OF CORRECTION

PATENT NO. : 7,300,146 B2
APPLICATION NO. : 10/394117
DATED : November 27, 2007
INVENTOR(S) : Carrie Roberts It is certified that error appears in the above-identified patent and that said Letters Patent is hereby corrected as shown below:

In column 7, line 18, in Claim 8, after “media” insert -- ; --.

In column 8, line 29, in Claim 23, after “liquid is” delete “clear” and insert -- wet --, therefor.

Signed and Sealed this

Twenty-sixth Day of August, 2008

JON W. DUDAS
*Director of the United States Patent and Trademark Office*